US005294490A

United States Patent [19]

Sasaki et al.

[11] Patent Number: 5,294,490

[45] Date of Patent: Mar. 15, 1994

[54] ENCAPSULATED TONER FOR HEAT-AND-PRESSURE FIXING

[75] Inventors: Mitsuhiro Sasaki; Kuniyasu Kawabe, both of Wakayama, Japan

[73] Assignee: KAO Corporation, Tokyo, Japan

[21] Appl. No.: 885,968

[22] Filed: May 20, 1992

[30] Foreign Application Priority Data

May 20, 1991 [JP] Japan ..... 3-114623
May 20, 1991 [JP] Japan ..... 3-114624

[51] Int. Cl.[5] ..... G03G 9/14

[52] U.S. Cl. ..... 428/402.21; 428/321.5; 428/402.22; 428/422.8

[58] Field of Search ..... 428/402.21, 402.22, 428/321.5, 422.8; 430/109, 110, 98, 106.6

[56] References Cited

U.S. PATENT DOCUMENTS 4,803,144 2/1989 Hosoi ..... 430/106.6
4,977,052 12/1990 Mikami ..... 430/98
5,043,240 8/1991 Ong et al. ..... 430/109

FOREIGN PATENT DOCUMENTS 0088566 9/1983 European Pat. Off. .
0225476 6/1987 European Pat. Off. .
0416897 3/1991 European Pat. Off. .
0453857 10/1991 European Pat. Off. .
2107892 5/1983 United Kingdom .
2097947 10/1992 United Kingdom .

*Primary Examiner*—Patrick J. Ryan
*Assistant Examiner*—William A. Krynski
*Attorney, Agent, or Firm*—Birch, Stewart, Kolasch & Birch

[57] ABSTRACT

An encapsulated toner for heat-and-pressure fixing having excellent offset resistance and blocking resistance, being fixed at a low fixing temperature and being regulated with the charging properties thereof from the inside of the encapsulated toner to stably and repeatedly form a scum-free, clear image many times, comprised of a heat-fusible core containing at least a coloring material, a binder and an electric charge control agent selected from the group consisting of a positive electric charge control agent, a negative electric charge control agent and a mixture thereof at a weight ratio of one to the other ranging from 1:0 (exclusive) to 1:0.5, and a shell formed so as to cover the surface of the core, wherein the main component of the shell is a resin prepared by reacting (A) an iso(thio)cyanate compound comprising (1) 0 to 30 mole % of monovalent isocyanate and/or isothiocyanate compounds, and (2) 100 to 70 mole % of at least divalent isocyanate and/or isothiocyanate compounds, with (B) an active hydrogen compound comprising (3) 0 to 30 mole % of a compound having one active hydrogen atom reactive with isocyanate and/or isothiocyanate groups, and (4) 100 to 70 mole % of a compound having at least two active hydrogen atoms reactive with isocyanate and/or isothiocyanate groups, at a molar ratio of component (A) to component (B) of between 1:1 and 1:20, and wherein at least 30% of all of the linkages in which an isocyanate and/or isothiocyanate group participates are thermally dissociable linkages.

6 Claims, No Drawings

ENCAPSULATED TONER FOR HEAT-AND-PRESSURE FIXING

BACKGROUND OF THE INVENTION

1. Field of the Invention

The present invention relates to an encapsulated toner for use in the development of an electrostatic latent image formed in electrophotography, electrostatic printing and electrostatic recording, and more particularly to a charged encapsulated toner for heat-and-pressure fixing.

2. Description of the Related Art

As described in U.S. Pat. Nos. 2,297,691 and 2,357,809, conventional electrophotography comprises the steps of uniformly charging a photoconductive insulating layer, subjecting the layer to exposure, selectively dissipating the charge on the exposed portion to form an electric latent image, depositing a fine charged powder having a color called a toner to form a visual image (step of development), transferring the resultant visual image onto a transfer material, such as transfer paper (step of transfer), and permanently fixing the visual image by heating, pressure or other suitable fixation methods (step of fixation).

Thus the toner should have properties required not only in the step of development but also in the steps of transfer and fixation.

In general, a toner is subjected to mechanical frictional force derived from shear force and impact force during the mechanical action in a development apparatus and deteriorates while copying several thousands to several tens of thousands of sheets of paper. The use of a tough resin having a large molecular weight capable of withstanding the mechanical frictional force suffices for the prevention of the above-described deterioration of the toner. These resins generally have a high softening point, and thus satisfactory fixation cannot be conducted in an oven fixation process and a radiant fixation process by means of infrared radiation as the non-contact fixation system, due to its poor heat efficiency. Also, in a heat pressure fixation system utilizing a heated roller etc., which is one of the contact fixation systems which have been widely used by virtue of its good heat efficiency, it is necessary to raise the temperature of the heat roller for the purpose of attaining satisfactory fixation. This brings about an unfavorable phenomena such as deterioration of the fixation apparatus, curling of paper and an increase in the energy consumption. Further, since the pulverizability of the above-described resin is so poor, the production efficiency is remarkably lowered in the production of the toner. For this reason, a binder resin having an excessively high degree of polymerization and an excessively high softening point cannot be used.

A heat pressure fixation system utilizing a heating roller and the like is used in a wide range of applications from low speed copying to high speed copying by virtue of a very good heat efficiency because the surface of the heat roller comes into pressure contact with the surface of the toner image of the fixation sheet. However, when the surface of the heat roller comes into contact with the surface of the toner image, the toner is deposited on the surface of the heat roller and is transferred to succeeding transfer paper, that is, it tends to bring about the so-called offset phenomenon. In order to prevent the above-described phenomena, the surface of the heat roller is provided with a material having good release properties, such as a fluororesin, and further the surface of the heat roller is coated with a release agent, such as a silicone oil. The method wherein the surface of the heat roller is coated with a silicone oil and the like, however, brings about an increase in the cost due to an increase in the size of the fixation apparatus. Furthermore, this unfavorably increases the complexity of the system and is likely to bring about additional problems.

Further, as described in Japanese Patent Publication No. 493/1982 and Japanese Patent Laid-Open Nos. 44836/1975 and 37353/1982, although there is a method wherein the resin which is asymmetrized or crosslinked is used to alleviate the offset phenomenon, no improvement in the fixation temperature can be attained.

Since the lowest fixation temperature is generally between the low temperature offset disappearance temperature and the high temperature offset generation temperature, the acceptable temperature region falls between the lowest fixation temperature and the high temperature offset generation temperature. The acceptable fixation temperature can be lowered and the acceptable temperature region can be broadened by making the lower fixation temperature as low as possible and making the high temperature offset generation temperature as high as possible, which contributes to a saving of energy, fixation at a high speed and prevention of the curling of the paper.

For this reason, a toner always exhibiting good fixation and offset resistance has been desired in the art.

A proposal has heretofore been made as to the use of an encapsulated toner comprising a core material and an outer shell which covers the surface of the core material for the purpose of improving fixation at a low temperature.

When a plastic deformable low melting point wax or the like is used as the core material (see U.S. Pat. No. 3,269,626, Japanese Patent Publication Nos. 15876/1971 and 9880/1969 and Japanese Patent Laid-Open Nos. 75032/1973 and 75033/1973), although fixation can be attained by the application of pressure alone, the fixation strength is so poor that this method can be used only for limited applications.

When use is made of a liquid core material, fixation can be attained by the application of pressure alone in the case where the strength of the shell material is small. In this case, however, the shell is frequently broken within the developing device which causes the inside of the device to become stained. On the other hand, when the strength of the shell material is excessively large, high pressure is necessary for breaking the capsule, which brings about the formation of an image having an excessively high gloss. This made it difficult to regulate the strength of the shell material.

For this reason, for use in heat pressure fixation, a proposal has been made on a microcapsulated toner for heat roller fixation, comprising a core material made of a resin having a low glass transition point which is capable of improving the fixation strength, although single use thereof brings about blocking at a high temperature, and an outer shell comprised of a high melting point resin wall formed by interfacial polymerization for the purpose of imparting blocking resistance (see Japanese Patent Laid-Open No. 56352/1986). In this toner, however, since the wall material (or the outer shell) has a high melting point, the performance of the core material cannot be sufficiently attained.

According to the same line of thinking, a proposal has been made on an encapsulated toner for heat roller fixation which is improved in the fixation strength of the core material (Japanese Patent Laid-Open Nos. 128357/1988, 128358/1988, 128359/1988, 128360/1988, 128361/1988 and 128362/1988). However, since these toners are produced by spray drying, a burden is imposed on the production facilities. Furthermore, since no device or contrivance is conducted concerning the outer shell, the performance of the core material cannot be sufficiently attained.

Further, as proposals of an encapsulated toner comprising a core material and an outer shell, U.S. patent application Ser. No. 680,538, European Patent Publication No. 0,453,857 which was published Oct. 30, 1991, U.S. patent application Ser. No. 833,502 are cited.

Although it has been tried to control the chargeability of the encapsulated toner by incorporating a charge control agent into the shell of the encapsulated toner or at the surface thereof, problems were created in that the charge control agent might be removed from the toner by, for example, friction with the carrier and adherence to the carrier to reduce the quantity of the electrification or charge of the toner, causing scumming or stain, or scattering the toner in the apparatus during the development. Further, when no charge control agent is present on the toner surface, the charging velocity is reduced depending on the kind of carrier and the scumming and scattering of the toner are often caused in the high-speed printing process.

An object of the present invention is to provide an encapsulated toner for heat-and-pressure fixing which exhibits excellent offset resistance and blocking resistance in a heat pressure fixation system utilizing a heated roller, and which can be fixed at a low fixing temperature.

Another object of the present invention is to provide an encapsulated toner for heat-and-pressure fixing wherein the electrification or charging properties of the toner can be controlled from inside the encapsulated toner to stably and repeatedly form a scumming-free, clear image.

The present invention relates to an encapsulated toner for heat-and-pressure fixing which is comprised of a heat-fusible core containing at least a coloring material, a binder and an electric charge control agent selected from the group consisting of a positive type electric charge control agent, a negative type electric charge control agent and a mixture of a positive type electric charge control agent and a negative type electric charge control agent at a weight ratio of one to the other ranging from 1:0 (exclusive) to 1:0.5, and a shell formed so as to cover the surface of the core, wherein the main component of the shell is a resin prepared by reacting (A) an iso(thio)cyanate compound comprising (1) 0 to 30 mole % of monovalent isocyanate and/or isothiocyanate compounds, and (2) 100 to 70 mole % of at least divalent isocyanate and/or isothiocyanate compounds, with (B) an active hydrogen compound comprising (3) 0 to 30 mole % of a compound having one active hydrogen atom reactive with isocyanate and/or isothiocyanate groups, and (4) 100 to 70 mole % of a compound having at least two active hydrogen atoms reactive with isocyanate and/or isothiocyanate groups, at a molar ratio of component (A) to component (B) of between 1:1 and 1:20, and wherein at least 30% of all of the linkages in which an isocyanate and/or isothiocyanate group participates are thermally dissociable linkages.

Namely, the present invention includes an encapsulated toner for heat and pressure fixing which comprises a meltable core containing at least a colorant and one or more charge control agent(s) of positive charging type and a shell covering the core surface, characterized in that the shell comprises, as a main component, a resin obtained by reacting the following compounds:

(1) 0 to 30 molar %, based on the total of isocyanate compounds and/or isothiocyanate compounds, of a monovalent isocyanate compound and/or isothiocyanate compound, and (2) 100 to 70 molar %, based on the total of isocyanate compounds and/or isothiocyanate compounds, of a divalent or higher isocyanate compound and/or isothiocyanate compound, with the following compounds:

(3) 0 to 30 molar %, based on the total of compounds reactive with an isocyanate group and/or isothiocyanate group, of a compound having one active hydrogen atom reactive with an isocyanate group and/or isothiocyanate group, and (4) 100 to 70 molar %, based on the total of compounds reactive with an isocyanate group and/or isothiocyanate group, of a compound having two or more active hydrogen atoms reactive with an isocyanate group and/or isothiocyanate group, in such amounts that the molar ratio of (1) plus (2) to (3) plus (4) is in the range of 1:1 to 1:20, and at least 30% of all the bonds in which the isocyanate groups and/or isothiocyanate groups of the resin participate are thermally dissociable bonds.

The present invention also includes an encapsulated toner for heat and pressure fixing which comprises a meltable core containing at least a colorant and one or more charge control agent(s) of negative charging type and a shell covering the core surface, characterized in that the shell comprises, as a main component, a resin obtained by reacting the following compounds:

(1) 0 to 30 molar %, based on the total of isocyanate compounds and/or isothiocyanate compounds, of a monovalent isocyanate compound and/or isothiocyanate compound, and (2) 100 to 70 molar %, based on the total of isocyanate compounds and/or isothiocyanate compounds, of a divalent or higher isocyanate compound and/or isothiocyanate compound, with the following compounds:

(3) 0 to 30 molar %, based on the total of compounds reactive with an isocyanate group and/or isothiocyanate group, of a compound having one active hydrogen atom reactive with an isocyanate group and/or isothiocyanate group, and (4) 100 to 70 molar %, based on the total of compounds reactive with an isocyanate group and/or isothiocyanate group, of a compound having two or more active hydrogen atoms reactive with an isocyanate group and/or isothiocyanate group, in such amounts that the molar ratio of (1) plus (2) to (3) plus (4) is in the range of 1:1 to 1:20, and at least 30% of all the bonds in which the isocyanate groups and/or isothiocyanate groups of the resin participate are thermally dissociable bonds.

The thermally dissociable linkages are preferably those formed by the reaction of a phenolic hydroxyl and/or thio group with an isocyanate and/or isothiocyanate group.

The characteristic feature of the present invention is further remarkable when the main ingredient of the heat-fusible core in the encapsulated toner is a thermoplastic resin with a glass transition point of 10° to 50° C. as the binder, and the softening point of the encapsulated toner is 80° to 150° C.

The present invention further relates to a toner composition for heat-and-pressure fixing which comprises the above-described encapsulated toner and a fine powder of a hydrophobic silica.

Further scope and applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The heat-fusible core of the encapsulated toner for heat-and-pressure fixing according to the present invention contains at least a coloring material, a binder and an electric charge control agent.

Any of the dyes, pigments and other coloring materials used as the conventional toner coloring material can be used as the coloring material to be contained in the core of the encapsulated toner of the present invention.

The coloring materials used in the present invention include various types of carbon black produced by thermal black processes, acetylene black processes, channel black processes, lamp black processes, etc., a grafted carbon black produced by coating the surface of carbon black with a resin, Phthalocyanine Blue, Permanent Brown FG, Brilliant Fast Scarlet, Pigment Green B, Rhodamine-B base, Solvent Red 49, Solvent Red 146, Solvent Blue 35 and mixtures thereof. They are used usually present in an amount of about 1 to 15 parts by weight per 100 parts by weight of the resin as a binder, which will be described below, in the core.

The electric charge control agent is a positive type electric charge control agent, a negative type electric charge control agent and a mixture of both.

The electric charge control agent of the positive charging type to be incorporated into the core according to the present invention includes, for example, Nigrosine dyes such as Nigrosine Base EX, Oil Black BS, Oil Black SO, Bontron N-01, Bontron N-07 and Bontron N-11 (products of Orient Chemical Industry Co., Ltd.); triphenylmethane dyes having a tertiary amine as a side chain; quaternary ammonium salt compounds such as Bontron P-51 (a product of Orient Chemical Industry Co., Ltd.), cetyltrimethylammonium bromide and Copy Charge PX VP 435 (a product of Hoechst); polyamine resins such as AFP-B (a product of Orient Chemical Industry Co., Ltd.); and imidazole derivatives.

The electric charge control agent of the negative charging type includes, for example, metal-containing azo dyes such as Varifast Black 3804, Bontron S-31, Bontron S-32, Bontron S-34 (products of Orient Chemical Industry Co., Ltd.) and Aizen Spilon Black TVH (a product of Hodogaya Chemical Co., Ltd.); copper phthalocyanine dyes; metal complexes of alkyl derivatives of salicyclic acid such as Bontron E-81, Bontron E-82 and Bontron E-85 (products of Orient Chemical Industry Co., Ltd.); quaternary ammonium salts such as Copy Charge NX VP 434 (a product of Hoechst); and nitroimidazole derivatives.

In the present invention, the electric charge control agent of positive charging type can be used in combination with the electric charge control agent of negative charging type. When the positive type electric charge control agent is used together with the negative type electric charge control agent, the weight ratio of one to the other ranges from 1:0 (exclusive) to 1:0.5. When the amount of the negative type charge control agent is at most one half of the positive type charge control agent, or when the amount of the positive type charge control agent is at most one half of the negative type charge control agent, the charge stability of the toner is further improved depending on the substance which charges or electrifies the toner, such as the carrier, and an excellent visible image can be formed without a lowering of the density, even after the continuous printing of 100,000 or more prints.

The entire amount of the charge control agent contained in the core is 0.1 to 8.0% by weight, preferably 0.2 to 5.0% by weight based on the entire weight of the core.

The heat-fusible core of the encapsulated toner for heat-and-pressure fixing according to the present invention also contains a resin as a binder ("core resin", hereinafter).

The resins usable as a core resin include thermoplastic resins having a glass transition point (Tg) of 10° to 50° C. such as polyester resins, polyester/polyamide resins, polyamide resins and vinyl resins. Among them, the vinyl resins are particularly preferred.

The monomers constituting the vinyl resins include, for example, styrene and its derivatives such as styrene per se, o-methylstyrene, m-methylstyrene, p-methylstyrene, α-methylstyrene, p-ethylstyrene, 2,4-dimethylstyrene, p-chlorostyrene and vinylnaphthalene; ethylenically unsaturated monoolefins such as ethylene, propylene, butylene and isobutylene; vinyl compounds such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isoproyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted ethylenically monocarboxylic acids such as acrylonitrile, methacrylonitrile and acrylamide; substituted and unsubstituted ethylenically dicarboxylic acids such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

As the constituents, that is monomers, of the resin used for forming the core resin in the present invention, preferably 50 to 90% by weight based on the entire monomers of styrene and/or styrene derivative is used for forming the main skeleton of the resin and preferably 10 to 50% by weight based on the entire monomers of an ethylenically monocarboxylic acid and/or its ester is used for modifying the thermal properties such as the softening point of the resin.

When a crosslinking agent is added to the monomer composition which is polymerized to form the core resin in the present invention, the crosslinking agents usable herein are ordinary ones such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate. They are suitably used either singly or, if necessary, in combination of two or more of them.

When such a crosslinking agent is used in an excess amount, it becomes so difficult to melt the toner by heat that the heat fixation or heat-and-pressure fixation is deteriorated. On the contrary, when the amount thereof is insufficient, it becomes difficult to prevent the offset phenomenon wherein during the heat-and-pressure fixation, part of the toner does not completely fix on the paper, deposits on the surface of the roller and transfers to the next paper. The amount of the crosslinking agent used is preferably 0.001 to 15% by weight, still more preferably 0.1 to 10% by weight, based on the polymerizable monomers except for the crosslinking agent.

The above-described monomers can be polymerized in the presence of an unsaturated polyester to form a graft or crosslinked polymer to be used as the core resin.

In the production of the vinyl resins, use is made of a polymerization initiator, and examples thereof include azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

A mixture of two or more polymerization initiators can be used in order to regulate the molecular weight and molecular weight distribution of the polymer or to control the reaction time.

The amount of the polymerization initiator used is 0.1 to 20 parts by weight, preferably 1 to 10 parts by weight based on 100 parts by weight of the polymerizable monomers, except for the crosslinking agent.

The core material may contain, if necessary, one or more offset inhibitors or offset preventive agents such as polyolefins, metal salts of fatty acids, fatty acid esters, partially saponified fatty acid esters, higher fatty acids, higher alcohols, paraffin waxes, amide waxes, polyhydric alcohol esters, silicone varnishes, aliphatic fluorocarbons and silicone oils in order to improve the offset resistance in the heat-and-pressure fixing.

Examples of the polyolefin include resins, such as polypropylene, polyethylene and polybutene, which have a softening point of 80° to 160° C. The metal salts of fatty acids include, for example, metal maleates such as zinc, magnesium and calcium maleates; metal stearates such as zinc, cadmium, barium, lead, iron, nickel, cobalt, copper, aluminum and magnesium stearates; lead dibasic stearate; metal oleates such as zinc, magnesium, iron, cobalt, copper, lead and calcium oleates; metal palmitates such as aluminum and calcium palmitates; caprylic acid salts; lead caproate; metal linoleates such as zinc and cobalt linoleates; calcium ricinolate; metal ricinoleates such as zinc and cadmium ricinoleates; and mixtures of them. The fatty acid esters include, for example, ethyl maleate, butyl maleate, methyl stearate, butyl stearate, cetyl palmitate and ethylene glycol montanate. The partially saponified fatty acid esters include, for example, montanic acid esters partially saponified with calcium. The higher fatty acids include for example, dodecanoic acid, lauric acid, myristic acid, plamitic acid, stearic acid, oleic acid, linoleic acid, ricinoleic acid, arachic acid, behenic acid, lignoceric acid, selacholeic acid and mixtures thereof. The higher alcohols include, for example, dodecyl alcohol, lauryl alcohol, myristyl alcohol, palmityl alcohol, stearyl alcohol, arachyl alcohol and behenyl alcohol. The paraffin waxes include, for example, natural paraffin, microcrystalline wax, synthetic paraffins and chlorinated hydrocarbons. The amide waxes include, for example, stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthaloylbisstearylamide and N,N'-isophthaloylbis-12-hydroxystearylamide. The polyhydric alcohol esters include, for example, glycerol stearate, glycerol ricinoleate, glycerol monobehenate, sorbitol monostearate, propylene glycol monostearate and sorbitan trioleate. The silicone varnishes include, for example, methylsilicone varnish and phenylsilicone varnish. The aliphatic fluorocarbons include, for example, low polymers of tetrafluoroethylene and hexafluoropropylene and fluorine-containing surfactants described in Japanese Patent Laid-Open No. 124428/1978.

However, when the shell is to be produced by interfacial polymerization process or in-situ polymerization process in the production of the encapsulated toner, it is not preferred to use a large amount of a compound having a functional group reactive with an isocyanate group, such as a higher fatty acid or higher alcohol, in the core material since it inhibits the shell formation and impairs the storability of the encapsulated toner.

The offset inhibitor is used preferably in an amount of 1 to 20% by weight based on the resin in the core material.

When the formation of a magnetic encapsulated toner is intended, a magnetic particle may be added to the core material. The magnetic particles include, for example, metals having a ferromagnetism, such as iron, cobalt and nickel or alloys thereof, such as ferrite and magnetite, or compounds containing these elements, or alloys not containing any ferromagnetic element but capable of exhibiting a ferromagnetism upon being subjected to a suitable heat treatment, such as, for example, alloys called "heusler alloys" and including manganese and copper, such as manganese-copper-aluminum, manganese-copper-tin, and chromium dioxide. The above-described magnetic substance is homogeneously dispersed in the form of a fine powder having a mean particle diameter of 0.1 to 1 μm in the core material. The content of the magnetic substance is 20 to 70 parts by weight, preferably 30 to 70 parts by weight based on 100 parts by weight of the encapsulated toner.

When the fine magnetic powder is to be incorporated into the toner to make it magnetic, the same process as that for the incorporation of the coloring material can be employed. Since the fine magnetic powder per se has only a poor affinity for the organic substances such as the raw material used for the core material including the monomers, it can be used together with a so-called "coupling agent", such as a titanium coupling agent, a silane coupling agent or lecithin, or after treatment with the coupling agent to be homogeneously dispersed.

Furthermore, a silicone oil as a flow improver and a metal salt of a higher fatty acid as a cleaning improver may be added in the core material.

In the present invention, the outer shell of the encapsulated toner for heat-and-pressure fixing is mainly composed of a resin which is prepared by reacting (A) and iso(thio)cyanate compound comprising (1) 0 to 30 mole % of monovalent isocyanate and/or isothiocyanate compounds, and (2) 100 to 70 mole % of at least divalent isocyanate and/or isothiocyanate compounds, with (B) an active hydrogen compound comprising or consisting essentially of (3) 0 to 30 mole % of a compound having one active hydrogen atom reactive with isocyanate and/or isothiocyanate groups, and (4) 100 to 70 mole % of a compound having at least two active hydrogen atoms reactive with isocyanate and/or isothiocyanate groups, at a molar ratio of component (A) to component (B) of between 1:1 and 1:20, and wherein at least 30% of all of the linkages in which an isocyanate and/or isothiocyanate group participates are thermally dissociable linkages.

The thermally dissociable linkage or bond includes, for example, an amide bond, an urethane bond, an urea bond, a thioamide bond, a thiourethane bond and a thiourea bond, and is formed by the reaction of an iso(-thio)cyanate group with an active hydrogen. When heating is conducted, the thermally dissociable linkage dissociates into an iso(thio)cyanate group and a hydroxyl group, although the linkage is in a dissociative equilibrium state below a thermally dissociable temperature.

In the present invention, the thermally dissociable linkages are preferably those formed by the reaction of a phenolic hydroxyl group and/or thiol group with an isocyanate group and/or isothiocyanate group. For example, a urethane bond which can be thermally dissociated is one which is dissociated to form an isocyanate group and a hydroxyl group at a certain temperature. This is also known as a blocked isocyanate and well known in the field of paints.

Blocking of polyisocyanates is conducted in the presence of a blocking agent, and is known as a method of temporarily preventing a reaction of an isocyanate group with an active hydrogen. Documents such as Z. W. Wicks Jr., Prog. in Org. Coatings, vol. 3, 73 (1975) describe various blocking agents, for example, tertiary alcohols, phenols, acetoacetic acid esters and ethyl malonate.

In the thermally dissociable polyurethane favorably used as a thermoplastic resin in the present invention, it is important to have a low thermally dissociable temperature. As can be seen also from the results described in documents such as G. R. Grittin and L. J. Willwerth, Ind. Eng. Chem. Prod. Res. Develop., Vol. 1, 265 (1962), among resins having urethane bonds, a resin having a urethane bond formed by a reaction of an isocyanate compound with a phenolic hydroxyl group has a low thermally dissociable temperature and is preferably used.

The thermal dissociation is an equilibrium reaction as represented, for example, by the following formula and is known to proceed from the right side to the left side of the formula as the temperature is elevated:

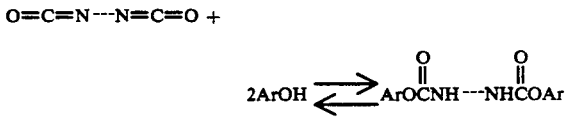

wherein Ar represents an aromatic group.

Examples of the monovalent isocyanate compounds (1) used in the present invention include ethyl isocyanate, octyl isocyanate, 2-chloroethyl isocyanate, chlorosulfonyl isocyanate, cyclohexyl isocyanate, n-dodecyl isocyanate, butyl isocyanate, n-hexyl isocyanate, lauryl isocyanate, phenyl isocyanate, m-chlorophenyl isocyanate, 4-chlorophenyl isocyanate, p-cyanophenyl isocyanate, 3,4-dichlorophenyl isocyanate, o-tolyl isocyanate, m-tolyl isocyanate, p-tolyl isocyanate, p-toluenesulfonyl isocyanate, 1-naphthyl isocyanate, o-nitrophenyl isocyanate, m-nitrophenyl isocyanate, p-nitrophenyl isocyanate, phenyl isocyanate, p-bromophenyl isocyanate, o-methoxyphenyl isocyanate, m-methoxyphenyl isocyanate, p-methoxyphenyl isocyanate, ethyl isocyanatoacetate, butyl isocyanatoacetate and trichloroacetyl isocyanate.

The divalent or higher isocyanate compounds (2) used in the present invention include, for example, aromatic isocyanate compounds such as 2,4-tolylene diisocyanate, a dimer of 2,4-tolylene diisocyanate, 2,6-tolylene diisocyanate, p-xylylene diisocyanate, m-xylylene diisocyanate, 4,4'-diphenylmethane diisocyanate, 1,5-naphthylene diisocyanate, 3,3'-dimethyldiphenyl-4,4'-diisocyanate, 3,3'-dimethyldiphenylmethane-4,4'-diisocyanate, m-phenylene diisocyanate, triphenylmethane triisocyanate, diphenylmethane triisocyanate and polymethylenephenyl isocyanate; aliphatic isocyanate compounds such as hexamethylene diisocyanate, trimethylhexamethylene diisocyanate, lysine diisocyanate, dimer acid diisocyanates and butane 1,2,2-triisocyanate; alicyclic isocyanate compounds such as isophorone diisocyanate, 4,4'-methylenebis(cyclohexylisocyanate), methylcyclohexane-2,4(or 2,6)-diisocyanate and 1,3-(isocyanatomethyl)-cyclohexane; and adduct of 3 mol of tolylene diisocyanate and 1 mol of trimethylolpropane.

Among them, compounds having an isocyanate group directly bonded to an aromatic ring are preferably used, since they are effective in lowering the thermal dissociation temperature after the formation of the urethane bond.

Examples of the compounds having an isothiocyanate group include phenyl isothiocyanate, xylylene-1,4-diisothiocyanate and ethylidyne diisothiocyanate.

The monovalent isocyanate and/or isothiocyanate compounds (1) which acts also as a molecular weight regulator for the shell resin can be used in an amount of 30 mole % or less based on the whole of isocyanate compounds and isothiocyanate compounds. When it exceeds 30 mole %, the storability of the encapsulated toner is impaired unfavorably.

In the present invention, the compounds (3) having one active hydrogen atom reactive with isocyanate and/or isothiocyanate groups include, for example, aliphatic alcohols such as methanol, ethanol, n-propyl alcohol, isopropyl alcohol, n-butyl alcohol, isobutyl alcohol, t-butyl alcohol, pentyl alcohol, hexyl alcohol, cyclohexyl alcohol, heptyl alcohol, octyl alcohol, nonyl alcohol, decyl alcohol, lauryl alcohol and stearyl alcohol; aromatic alcohols such as phenol, o-cresol, m-cresol, p-cresol, 4-butylphenol, 2-sec-butylphenol, 2-tert-butylphenol, 3-tert-butylphenol, 4-tert-butylphenol, nonylphenol, isononylphenol, 2-propenylphenol, 3-propenylphenol, 4-propenylphenol, 2-methoxyphenol, 3-methoxyphenol, 4-methoxyphenol, 3-acetylphenol, 3-carbomethoxyphenol, 2-chlorophenol, 3-chlorophenol, 4-chlorophenol, 2-bromophenol, 3-bromophenol, 4-bromophenol, benzyl alcohol, 1-naphthol, 2-naphthol and 2-acetyl-1-naphthol; and amides such as ϵ-caprolactam.

Among them, phenol derivatives represented by the following formula (I) are preferably used:

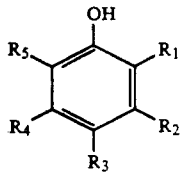

(I)

wherein $R_1$, $R_2$, $R_3$, $R_4$ and $R_5$ each independently represent a hydrogen atom, an alkyl group having 1 to 9 carbon atoms, an alkenyl group having 1 to 9 carbon atoms, an alkoxy group having 1 to 9 carbon atoms, an alkanoyl group having 1 to 9 carbon atoms, a carboalkoxy group having 2 to 9 carbon atoms, an aryl group having 6 to 9 carbon atoms or a halogen atom.

Among the compounds (4) having at least two active hydrogen atoms reactive with isocyanate and/or isothiocyanate groups usable in the present invention, dihydric or higher alcohol compounds include, for example, catechol, resorcinol, hydroquinone, 4-methylcatechol, 4-t-butylcatechol, 4-acetylcatechol, 3-methoxycatechol, 4-phenylcatechol, 4-methylresorcinol, 4-ethylresorcinol, 4-t-butylresorcinol, 4-hexylresorcinol, 4-chlororesorcinol, 4-benzylresorcinol, 4-acetylresorcinol, 4-carbomethoxyresorcinol, 2-methylresorcinol, 5-methylresorcinol, t-butylhydroquinone, 2,5-di-t-butylhydroquinone, 2,5-di-t-amylhydroquinone, tetramethylhydroquinone, tetrachlorohydroquinone, methylcarboaminohydroquinone, methylureidohydroquinone, benzonorbornene-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2'-dihydroxydiphenylmethane, 3,4-bis(p-hydroxyphenyl)hexane, 1,4-bis(2-(p-hydroxyphenyl)-propyl)benzene, bis(4-hydroxyphenyl)-methylamine, 1,3-dihydroxynaphthalene, 1,4-dihydroxynaphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy 3,5-di-t-butylbenzyl alcohol, 4-hydroxy-3,5-di-t-butylbenzyl alcohol, 4-hydroxyphenethyl alcohol, 2-hydroxyethyl-4-hydroxybenzoate, 2-hydroxyethyl-4-hydroxyphenylacetate, resorcinol mono-2-hydroxyethyl ether, hydroxyhydroquinone, gallic acid and ethyl 3,4,5-trihydroxybenzoate. Among them, catechol derivatives represented by the following formula (II) or resorcinol derivatives represented by the following formula (III) are preferably used:

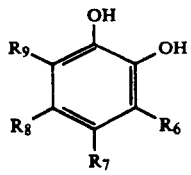

(II)

wherein $R_6$, $R_7$, $R_8$ and $R_9$ each independently represent a hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom; and

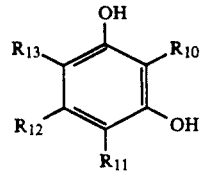

(III)

wherein $R_{10}$, $R_{11}$, $R_{12}$ and $R_{13}$ each independently represent a hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom.

The compounds having at least one functional group (other than hydroxyl group) capable of reacting with an isocyanate and/or isothiocyanate group and having at least one phenolic hydroxyl group include, for example, o-hydroxybenzoic acid, m-hydroxybenzoic acid, p-hydroxybenzoic acid, 5-bromo-2-hydroxybenzoic acid, 3-chloro-4-hydroxybenzoic acid, 4-chloro-2-hydroxybenzoic acid, 5-chloro-2-hydroxybenzoic acid, 3,5-dichloro-4-hydroxybenzoic acid, 3-methyl-2-hydroxybenzoic acid, 5-methoxy-2-hydroxybenzoic acid, 3,5-di-t-butyl-4-hydroxybenzoic acid, 4-amino-2-hydroxybenzoic acid, 5-amino-2-hydroxybenzoic acid, 2,5-dinitrosalicylic acid, sulfosalicylic acid, 4-hydroxy-3-methoxyphenylacetic acid, catechol-4-carboxylic acid, 2,4-dihydroxybenzoic acid, 2,5-dihydroxybenzoic acid, 2,6-dihydroxybenzoic acid, 3,4-dihydroxybenzoic acid, 3,5-dihydroxybenzoic acid, 3,4-dihydroxyphenylacetic acid, m-hydroxycinnamic acid, p-hydroxycinnamic acid, 2-amino-4-methylphenol, 2-amino-5-methylphenol, 5-amino-2-methylphenol, 3-amino-2-naphthol, 8-amino-2-naphthol, 1-amino-2-naphthol-4-sulfonic acid, 2-amino-5-naphthol-4-sulfonic acid, 2-amino-4-nitrophenol, 4-amino-2-nitrophenol, 4-amino-2,6-dichlorophenol, o-aminophenol, m-aminophenol, p-aminophenol, 4-chloro-2-aminophenol, 1-amino-4-hydroxyanthraquinone, 5-chloro-2-hydroxyaniline, α-cyano-3-hydroxycinnamic acid, α-cyano-4-hydroxycinnamic acid, 1-hydroxynaphthoic acid, 2-hydroxynaphthoic acid, 3-hydroxynaphthoic acid and 4-hydroxyphthalic acid.

The thiol compounds having at least one thiol group in the molecule include, for example ethanethiol, 1-propanethiol, 2-propanethiol, thiophenol, bis(2-mercaptoethyl) ether, 1,2-ethanedithiol, 1,4-butanedithiol, bis(2-mercaptoethyl) sulfide, ethylene glycol bis(2-mercaptoacetate), ethylene glycol bis(3-mercaptopropionate), 2,2-dimethylpropanediol bis(2-mercaptoacetate), 2,2-dimethylpropanediol bis(3-mercaptopropionate), trimethylolpropane tris(2-mercaptoacetate), trimethylolpropane tris(3-mercaptopropionate), trimethylolethane tris(2-mercaptoacetate), trimethylolethane tris(3-mercaptopropionate), pentaerythritol tetrakis(2-mercaptoacetate), pentaerythritol tetrakis(3-mercaptopropionate), dipentaerythritol hexakis(2-mercaptoacetate), dipentaerythritol hexakis(3-mercaptopropionate), 1,2-dimercaptobenzene, 4-methyl-1,2-dimercaptobenzene, 3,6-dichloro-1,2-dimercaptobenzene, 3,4,5,6-tetrachloro-1,2-dimercaptobenzene, xylylenedithiol and 1,3,5-tris(3-mercaptopropyl) isocyanurate.

In the thermally dissociable outer shell resin used in the present invention, at least 30%, preferably at least 50%, of the total number of linkages in which the isocyanate and/or isothiocyanate groups of the resin participate are thermally dissociable linkages. When the number of thermally dissociable linkages is less than 30% per the total number of linkages in which the isocyanate and/or isothiocyanate groups participate, the reduction in the strength of the capsule shell is insufficient during the fixing by heat-and-pressure, so that the excellent fixing properties of the core material cannot be exhibited.

In the present invention, compounds having a functional group reactive with the isocyanate group, excepting for the phenolic hydroxyl group and thiol group, can be used as a shell-forming material in such an amount that at least 30% per the total number of linkages in which the isocyanate and/or isothiocyanate groups participate are the linkages formed by the reaction of the phenolic hydroxyl group and/or thiol group with the isocyanate and/or isothiocyanate groups. These compounds include active methylene compounds such as malonic esters and acetoacetic esters; oximes such as methyl ethyl ketone oxime; carboxylic acids; polyol; polyamines; aminocarboxylic acids; and aminoalcohols which will be described below.

The active methylene compounds include, for example, malonic acid, monomethyl malonate, monoethyl malonate, isopropyl malonate, dimethyl malonate, diethyl malonate, diisopropyl malonate, tert-butyl ethyl malonate, malondiamide, acetylacetone, methyl acetoacetate, ethyl acetoacetate, tert-butyl acetoacetate and allyl acetoacetate.

The carboxylic acids include, for example, monobasic carboxylic acids such as acetic acid, propionic acid, butyric acid, isobutyric acid, pentanoic acid, hexanoic acid and benzoic acid; dibasic carboxylic acids such as maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid and n-octylsuccinic acid; and tribasic and higher carboxylic acids such as 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid and trimer acid of empole.

The polyols include, for example, diols such as ethylene glycol, propylene glycol, butylene glycol, neopentyl glycol, hexamethylene glycol, diethylene glycol and dipropylene glycol; triols such as glycerol, trimethylolpropane, trimethylolethane and 1,2,6-hexanetriol; pentaerythritol and water. The polyamines include, for example, ethylenediamine, hexamethylenediamine, diethylenetriamine, iminobispropylamine, phenylenediamine, xylylenediamine and triethylenetetramine.

In the present invention, the compounds (3) having one active hydrogen atom reactive with isocyanate and/or isothiocyanate groups can be used in an amount of 30 mole % or below based on the entire compounds reactive with isocyanate and/or isothiocyanate groups. When the compounds (3) exceeds 30 mole %, the storability of the encapsulated toner is unfavorably impaired.

The molar ratio of (A) an iso(thio)cyanate compound comprising isocyanate compounds and/or isothiocyanate compounds (1)+(2) with (B) an active hydrogen compound comprising or consisting essentially of the compounds reactive with the isocyanate group and/or isothiocyanate group (3)+(4) is preferably in the range of 1:1 to 1:20 so as to leave no unreacted isocyanate group.

The quantity of the charge can be controlled by adding a suitable amount of the charge control agent exemplified above the outer shell of the encapsulated toner of the present invention or by mixing the charge control agent with the toner. The amount of the charge control agent which is incorporated into the outer shell or is mixed with the toner can be only small, since the charge has already been regulated by the charge control agent contained in the core.

In the production of the encapsulated toner, the shell is preferably formed by interfacial polymerization or in-situ polymerization. In addition, it can be formed by, for example, a dry process wherein mother particles as the core material are stirred together with daughter particles as the shell-forming material having a number-average particle diameter of $\frac{1}{8}$ or less of that of the mother particles at a high speed in a gas stream to form the shell.

Although the shell resin can be produced in the absence of a catalyst, tin catalysts such as dibutyltin dilaurate; amine catlysts such as 1,4-diazabicyclo[2.2.2]octane and N,N,N-tris-(dimethylaminopropyl)hexahydro-s-triazine; and known urethane catalysts can be used, if necessary.

When the encapsulated toner is produced by interfacial polymerization or in-situ polymerization, the material constituting the outer shell (or the monomer etc. which becomes the outer shell by polymerization) and the material constituting the core material (or the monomer etc. which becomes the core material by polymerization) are dispersed in the dispersion medium. In this connection, it is necessary to incorporate a dispersion stabilizer into the dispersion medium in order to prevent the agglomeration and coalescence of the dispersoid.

The dispersion stabilizers include, for example, gelatin, gelatin derivatives, polyvinyl alcohol, polystyrenesulfonic acid, hydroxymethylcellulose, hydroxyethylcellulose, hydroxypropylcellulose, sodium carboxymethylcellulose, poly(sodium acrylate), sodium dodecylbenzenesulfonate, sodium tetradecylsulfate, sodium pentadecylsulfate, sodium octylsulfate, sodium allylalkyl polyethersulfonates, sodium oleate, sodium laurate, sodium caprate, sodium caprylate, sodium caprate, potassium stearate, calcium oleate, sodium 3,3-disulfonediphenylurea-4,4-diazo-bis-amino-β-naphthol-6-sulfonate, o-carboxybenzene-azo-dimethylaniline, sodium 2,2,5,5-tetramethyl-triphenylmethane-4,4-diazo-bis-β-naphthol disulfonate, colloidal silica, alumina, calcium tertiary phosphate, ferric hydroxide, titanium hydroxide and aluminum hydroxide. These materials can be used also in combination of two or more.

The dispersion media for the above-described dispersion stabilizers include, for example, water, methanol, ethanol, propanol, butanol, ethylene glycol, glycerol, acetonitrile, acetone, isopropyl ether, tetrahydrofuran and dioxane. They can be used either singly or as a mixture.

As the encapsulated toner of the present invention, one wherein the main ingredient of the heat-fusible core is a thermoplastic resin and the glass transition point ascribable to the resin is 10° to 50° C. is preferred. When the glass transition point is less than 10° C., the storability of the encapsulated toner is insufficient and, on the contrary, when it exceeds 50° C., the fixing strength of the encapsulated toner unfavorably deteriorates. The glass transition point herein is that determined with a differential scanning calorimeter (a product of Seiko Instruments, Inc.) at a temperature elevation rate of 10° C./min. It is a temperature at the intersection of a line extended from the base line (below the glass transition point) and a tangent line showing the maximum gradient between the rising part of the peak and the top of the peak.

The softening point of the encapsulated toner is preferably 80° to 150° C. in the present invention. When it is below 80° C., the offset resistance deteriorates and, on the contrary, when it exceeds 150° C., the fixing strength unfavorably deteriorates. The softening point is herein determined with a Koka-type flow tester mfd. by Shimadzu Seisakusho Ltd. as follows: a sample having a volume of 1 $cm^3$ is extruded through a nozzle having a diameter of 1 mm and a length of 1 mm under a load of 20 $kg/cm^2$ with a plunger under heating at a temperature-elevation rate of 6° C./min. A S-shaped curve showing the relationship between the plunger descending distance (flow value) and the temperature of the flow tester is drawn and the softening point is given in terms of the temperature at h/2 wherein h is a height of the S-shaped curve.

Although the diameter of the encapsulated toner is not particularly limited in the present invention, the average diameter thereof is usually 3 to 30 μm. The thickness of the shell of the encapsulated toner is preferably 0.01 to 1 μm. When it is less than 0.01 μm, the blocking resistance deteriorates and, on the contrary, when it exceeds 1 μm, the meltability is impaired unfavorably.

The encapsulated toner of the present invention may be used with a flow improver, a cleaning improver, etc., if necessary. Namely, the capsulated toner may be used as a component of a toner composition. The flow improvers include, for example, silica, alumina, titanium oxide, barium titanate, magnesium titanate, calcium titanate, strontium titanate, zinc oxide, quartz sand, clay, mica, wollastonite, diatomaceous earth, chromium oxides, cerium oxides, red iron oxide, antimony trioxide, magnesium oxide, zirconium oxide, barium sulfate, barium carbonate, calcium carbonate, silicon carbide and silicon nitride. A fine powder of silica is preferred and a fine powder of a hydrophobic silica is particularly preferred as a flow improver.

The fine powder of silica is a fine powder of a compound having a Si-O-Si bond and may be produced by any of dry and wet processes. Although the fine powder of silica may contain any of aluminum silicate, sodium silicate, potassium silicate, magnesium silicate and zinc silicate in addition to anhydrous silicon dioxide, it is preferred for them to have an $SiO_2$ content of 85% by weight and more. Further, as the fine powder of silica, it is also possible to use a fine powder of silica subjected to a surface treatment with a silane coupling agent, a titanium coupling agent, a silicone oil, a silicone oil having an amino group on its side chain and the like.

The cleaning improvers include, for example, metal salts of higher fatty acids such as zinc stearate and fine powders of a fluoropolymer.

In addition, additives for regulating the developing properties such as fine powders of methyl methacrylate polymers may be used.

Further a small amount of a carbon black may be used for toning or controlling the resistance. The carbon blacks usable herein include various known ones such as furnace black, channel black and acetylene black.

When the encapsulated toner of the present invention contains a fine magnetic powder, it can be used alone as a developing agent. When it is free from the fine magnetic powder, it can be mixed with a carrier to prepare a binary developing agent. The carrier which is not particularly limited is preferably an iron powder, ferrite, or glass beads, each of which may be coated with a resin. The mixing ratio of the toner is 0.5 to 10% by weight based on the carrier. The particle diameter of the carrier used is 30 to 500 μm.

When the encapsulated toner of the present invention is fixed on a recording material such as paper by heat-and-pressure, an excellent fixing strength can be obtained. As far as use is made of a combination of heat with pressure, methods including known heat roller fixing processes, a fixing process as described in Japanese Patent Laid-Open No. 190870/1990 wherein an unfixed toner image on the recording material is heat-melted by heating means comprising a heating portion and a heat resistant sheet through the heat resistant sheet to conduct the fixation, a fixing process as described in Japanese Patent Laid-Open No. 162356/1990 wherein a toner image is fixed on a recording material by heat pressure fixation through the use of a fixed, supported heating material and a pressing member, which is provided to face and be in pressure contact with the heating material and makes the recording material close by adhering with the heating material through a film, are suitable for the fixation of the encapsulated toner of the present invention.

PREFERRED EMBODIMENTS

The present invention will now be described in more detail with reference to the following Examples, which should be considered as merely exemplary of the present invention.

EXAMPLE 1

7.0 parts by weight of carbon black "#44" mfd. by Mitsubishi Kasei Corp., 1.0 part by weight of charge control agent of positive charging type "Bontron N-01" (mfd. by Orient Chemical Industry Co., Ltd.), 3.5 parts by weight of 2,2'-azobisisobutyronitrile and 9.5 parts by weight of 4,4'-diphenylmethane diisocyanate "Millionate MT" (mfd. by Nippon Polyurethane Industry Co., Ltd.) were added to a mixture of 69.0 parts by weight of styrene with 31.0 parts by weight of 2-ethylhexyl acrylate and 0.9 part by weight of divinylbenzene. They were placed in an attritor mfd. by Mitsui Miike Engineering Corp. and subjected to dispersion at 10° C. for 5 h to prepare a polymerizable composition. The polymerizable composition was added to 800 g of a 4 wt. % solution of calcium phosphate (or calcium tertiary phosphate) in an aqueous colloid previously prepared in a 2-l separable glass flask in such an amount that the concentration of the polymerizable composition became 30% by weight based on the total of the aqueous colloid solution and the polymerizable composition. They were dispersed and emulsified on a TK Homomixer mfd. by Tokushu Kika Kogyo Co., Ltd. at 10,000 rpm at 5° C. for 2 min. A four neck glass lid was placed on the flask and fitted with a reflux condenser, a thermometer, a dropping funnel having a nitrogen-inlet tube and a stainless steel stirring rod. The flask was placed in an electric mantle. A mixed solution of 22.0 g of resorcinol, 3.6 g of diethyl malonate, 0.5 g of 1,4-diazabicyclo[2.2.2]octane and 40 g of deionized water was prepared and added dropwise into the flask through the dropping funnel while stirring over a period of 30 min. Then the temperature was elevated to 85° while continuing the stirring under nitrogen and the reaction was conducted for 10 h. After cooling the reaction mixture, the dispersant was dissolved by adding 10% aqueous hydrochloric acid solution, and the mixture was filtered. The residue was washed with water, dried at 45° under reduced pressure of 20 mmHg for 12 h, and classified by means of an air classifier to give an encapsulated toner having an average particle diameter of 9 μm wherein the shell comprises a resin having thermally dissociable urethane bonds. The glass transition point of the resin in the core material of the encapsulated toner and the softening point of the encapsulated toner were 28.5° C. and 130.5° C., respectively.

0.4 part by weight of a fine powder of a hydrophobic silica "Aerosil R-972" (mfd. by Aerosil Co. Ltd.) was added and mixed with 100 parts by weight of the encapsulated toner produced as described above to prepare the encapsulated toner composition of the present invention. This toner composition was designated as "Toner 1".

EXAMPLE 2

100 parts by weight of a copolymer consisting essentially of 75 parts by weight of styrene and 25 parts by weight of n-butyl acrylate and having a softening point of 75.3° C. and a glass transition point of 40.5° C. was premixed with 6 parts by weight of a copper phthalocyanine pigment "Sumikaprint Cyanine Blue GN-0" (mfd. by Sumitomo Chemical Co., Ltd.), 2.0 parts by weight of charge control agent of positive charging type "Copy Charge PX VP435" (mfd. by Hoechst) and 5 parts by weight of polypropylene wax "Biscol 550p" (mfd. by Sanyo Chemical Industries, Ltd.) and the mixture was melt-kneaded on a twin-screw extruder, cooled and pulverized. 40 parts by weight of the kneaded product was then mixed with 50 parts by weight of styrene, 15 parts by weight of n-butyl acrylate, 2.5 parts by weight of 2,2'-azobis(2,4-dimethylvaleronitrile), 9.0 parts by weight of an adduct of 3 mol of 2,4-tolylene diisocyanate and 1 mol of trimethylolpropane "Takenate D-102" (mfd. by Takeda Chemical Industries, Ltd.) and 0.5 part by weight of xylylene-1,4-diisothiocyanate to prepare a polymerizable composition. The polymerizable composition was added to 800 g of a 4 wt. % solution of calcium phosphate (or calsium tertiary phosphate) in an aqueous colloid previously prepared in a 2-l separable glass flask in such an amount that the concentration of the polymerizable composition became 30% by weight based on the total weight of the aqueous colloid solution and the polymerizable composition. They were dispersed and emulsified on a TK Homomixer mfd. by Tokushu Kika Kogyo Co., Ltd. at 10,000 rpm at 5° C. for 2 min. A four neck glass lid was placed on the flask and fitted with a reflux condenser, a thermometer, a dropping funnel having a nitrogen-inlet tube and a stainless steel stirring rod. The flask was placed in an electric mantle. A mixed solution of 27.4 g of 4-acetylcatechol, 4.0 g of dimethyl malonate, 0.8 g of 1,2-ethanedithiol, 0.5 g of 1,4-diazabicyclo[2.2.2]octane and 40 g of deionized water was prepared and added dropwise into the flask through a dropping funnel while stirring over a period of 30 min. Then the temperature was elevated to 85° C. while continuing the stirring under nitrogen and the reaction was conducted for 10 h. After cooling the reaction mixture, the dispersant was dissolved by adding 10% aqueous hydrochloric acid solution, and the mixture was filtered. The residue was washed with water, dried at 45° C. for 12 hr under a reduced pressure of 20 mmHg, and classified by means of an air classifier to give an encapsulated toner having an average particle diameter of 9 μm wherein the shell comprises a resin having thermally dissociable linkages. The glass transition point of the resin in the core material of the encapsulated toner and the softening point of the encapsulated toner were 34.5° C. and 132.5° C., respectively.

0.4 part by weight of a fine powder of a hydrophobic silica "Aerosil R-972" (mfd. by Aerosil Co. Ltd.) was added to 100 parts by weight of the encapsulated toner produced as described above to prepare the toner composition of the present invention. This toner composition was designated as "Toner 2".

EXAMPLE 3

40 parts by weight of carbon black grafted with styrene "GP-E-3" (manufactured by Ryoyu Kogyo K.K.), which contains 40% by weight of styrene monomer, 30% by weight of polystyrene and 30% by weight of grafted carbon black, 1.5 parts by weight of charge control agent of positive charging type "AFP-B" (mfd. by Orient Chemical Industry, Co., Ltd.), 4.5 parts by weight of lauroyl peroxide, 9.0 parts by weight of tolylene diisocyanate "Coronate T-100" (mfd. by Nippon Polyurethane Industry Co., Ltd.) and 0.5 part by weight of phenyl isocyanate were added to a mixture of 50 parts by weight of styrene with 35 parts by weight of 2-ethylhexyl acrylate and 0.9 part by weight of divinylbenzene to prepare a polymerizable composition.

The polymerizable composition was added to 800 g of a 4 wt. % solution of calcium phosphate in an aqueous colloid previously prepared in a 2-l separable glass flask in such an amount that the concentration of the polymerizable composition was 30% by weight based on the total of the aqueous colloid solution and the polymerizable composition. The mixture was dispersed and emulsified on a TK Homomixer mfd. by Tokushu Kika Kogyo Co., Ltd. at 10,000 rpm at 5° C. for 2 min. A four neck glass lid was placed on the flask and fitted with a reflux condenser, a thermometer, a dropping funnel having a nitrogen-inlet tube and a stainless steel stirring rod. The flask was placed in an electric mantle. A mixed solution of 24.0 g of resorcinol, 3.0 g of m-aminophenol, 2.2 g of t-butyl alcohol, 0.5 g of 1,4-diazabicyclo[2.2.2]octane and 40 g of deionized water was prepared and added dropwise into the flask through a dropping funnel while stirring over a period of 30 min. Then the temperature was elevated to 85° C. while continuing the stirring under nitrogen and the reaction was conducted for 10 h. After cooling the reaction mixture, the dispersant was dissolved by adding 10% aqueous hydrochloric acid solution, and the mixture was filtered. The residue was washed with water, dried at 45° C. for 12 hr under a reduced pressure of 20 mmHg, and classified by means of an air classifier to give an encapsulated toner having an average particle diameter of 9 μm wherein the shell comprises a resin having thermally dissociable urethane bonds. The glass transition point of the resin in the core material of the encapsulated toner and the softening point of the encapsulated toner were 32.0° C. and 129.0° C., respectively.

0.4 part by weight of a fine powder of a hydrophobic silica "Aerosil R-972" (mfd. by Aerosil Co., Ltd.) was added to 100 parts by weight of the encapsulated toner produced as described above to prepare the toner composition of the present invention. This toner composition was designated as "Toner 3".

COMPARATIVE EXAMPLE 1

The procedure of Example 1 was repeated except that no charge control agent of positive charging type "Bontron N-01" was used, thereby preparing a toner composition containing an encapsulated toner. This toner composition was designated as "Comparative Toner 1". The glass transition point of the resin in the core material of the encapsulated toner and the softening point of the encapsulated toner were 28.5° C. and 130.0° C., respectively.

COMPARATIVE EXAMPLE 2

The procedure of Example 2 was repeated except that no charge control agent of positive charging type "Copy Charge PX VP435" was used, thereby preparing a toner composition containing an encapsulated toner. This toner composition was designated as "Comparative Toner 2". The glass transition point of the resin in the core material of the encapsulated toner and the softening point of the encapsulated toner were 34.5° C. and 133.0° C., respectively.

COMPARATIVE EXAMPLE 3

The procedure of Example 3 was repeated except that no charge control agent of positive charging type "AFP-B" was used, thereby preparing a toner composition containing an encapsulated toner. This toner composition was designated as "Comparative Toner 3". The glass transition point of the resin in the core material of the encapsulated toner and the softening point of the encapsulated toner were 32.0° C. and 130.0° C., respectively.

COMPARATIVE EXAMPLE 4

The procedure of Example 1 was repeated except that 21.6 g of neopentyl glycol was used instead of 22.0 g of resorcinol and 3.6 g of diethyl malonate, thereby preparing a toner composition containing an encapsulated toner. This toner composition was designated as "Comparative Toner 4". The glass transition point of the resin in the core material of the encapsulated toner and the softening point of the encapsulated toner were 28.5° C. and 134.5° C., respectively.

10 parts by weight of each of the toner compositions produced in the Examples and Comparative Examples given above (Toner 1, 2 and 3, Comparative Toner 1, 2, 3 and 4) and 90 parts by weight of spheroidal ferrite powder coated with phenylsilicone resin and having a particle size of 250 to 400 mesh as a carrier were placed in a vessel made of a polymer, and each toner composition and the ferrite powder were subjected to rotational mixing together with the vessel at a number of revolutions of 150 rpm for 20 min, thereby preparing developing agents.

The resultant developing agents were subjected to the following evaluations.

The amount of electrification was measured by means of a blow-off electrification amount measuring apparatus. Specifically, use was made of a specific charge measuring apparatus equipped with a Farady cage, a capacitor and an electrometer. At the outset, W g (0.15 to 0.20 g) of the developing agent prepared above was placed in a measuring cell of brass equipped with a 500-mesh (suitably variable so far as the carrier particles do not pass through it) stainless mesh. After suction was conducted through a suction port for 5 sec, blowing was conducted for 5 sec by applying such a pressure that an air pressure regulator indicated a value of 0.6 kgf/cm$^2$, thereby removing only the toner composition from the cell.

During the blowing, the voltage was measured by an electrometer. The voltage of an electrometer determined 2 sec after the initiation of the blowing was taken as V (volt). In this case, when the electric capacity of the capacitor is taken as C (μF), the specific charge of the toner, Q/m, can be determined according to the following equation.

$$Q/m\ (\mu c/g) = \frac{C \times V}{m}$$

wherein m represents the weight of toner composition contained in W (g) of the development agent.

When the weight of the toner composition in the developing agent and the weight of the developing agent are T (g) and D (g), respectively, the toner composition concentration of the sample is represented by the formula $T/D \times 100$ (%) and the m value can be determined according to the following equation.

$$m(g) = W \cdot T/D$$

The results of the measurement of the amount of electrification for a developing agent prepared under usual environment are given in Table 1.

The printing durability tests were conducted by using a commercially available electrophotographic copy machine, and the amount of electrification after making 50,000 copies and scumming and scattering in the machine caused during the continuous durability test were evaluated. The results thereof are also given in Table 1.

The fixing properties were evaluated by the following method. Specifically, the developing agents prepared above was subjected to the formation of an image through the use of a commercially available electrophotographic copying machine (wherein the photoreceptor comprises an organic photoconductor, the rotational speed of the fixation roller was 390 mm/sec, the heat pressure temperature in the fixation apparatus was made variable, and the oil coating apparatus was omitted). The fixation temperature was regulated to 100° to 220° C. to evaluate the fixation of the image and the offset resistance. The results are given in Table 2.

The term "lowest fixation temperature" used herein is intended to mean a fixing roller temperature determined as follows. A load of 500 g is placed on a sand eraser having a bottom face size of 15 mm×7.5 mm. The surface of an image fixed through a fixation machine is rubbed by the eraser reciprocatingly five times. The optical reflection density is measured by means of a Mcbeth densitometer before and after the rubbing, and the fixation roller temperature at which the percentage fixation defined by the following equation exceeds 70% is determined as the lowest fixation temperature.

$$\text{Percentage fixation} = \frac{\text{image density after rubbing}}{\text{image density before rubbing}} \times 100$$

The "low temperature offset disappearance temperature" is determined as follows. An unfixed image was formed within a copying machine, and a test was conducted on a fixation temperature region by means of an external fixing machine. In the fixing roller of the external fixing machine, both upper and lower rollers were coated with a high heat resistant silicone rubber, and a heater was provided within the upper roller. Toner images formed by the above-described individual developing agents transferred on a transfer paper having a basis weight of 64 g/m$^2$ under environmental conditions of a temperature of 20° C. and a relative humidity of 20% were fixed at a linear velocity of 115 mm/sec by means of a heat roller fixing apparatus which was conducted by the stepwise raising of the set temperature of the heat roller from 120° C. In the resultant fixed image, a solid toner having a size of 2 cm×2 cm was folded in two, and the folded portion was inspected with the naked eye to determine the toner was fixed or not. The minimum preset temperature necessary for obtaining a fixed image was determined. This temperature was viewed as the low temperature offset disappearance temperature. The heat roller fixing apparatus is one not equipped with a silicone oil feed mechanism.

The "high temperature offset generation temperature" is determined as follows. According to the above-described measurement of the minimum fixing temperature, a toner image was transferred, a fixation treatment was conducted by means of the above-described heat roller fixing apparatus, and a transfer paper having a white color was fed to the above-described heat roller fixing apparatus under the same conditions to determine with the naked eye whether or not toner staining occurred. The above-described procedure was repeated in such a manner that the preset temperature of the heat roller of the above-described heat roller fixing apparatus was successively raised, thereby determining the minimum preset temperature at which the toner staining occurred. The minimum present temperature was viewed as the high temperature offset generation temperature.

Regarding the blocking resistance, the degree of occurrence of agglomeration when each toner composition was allowed to stand for 24 hr under conditions of a temperature of 50° C. and a relative humidity of 40% was evaluated, and the results are also given in Table 2.

TABLE 1

| | Amt. of electrification (μc/g) | | Continuous printing durability test | |
|---|---|---|---|---|
| | initial | after producing 50,000 copies | quality | scattering in machine |
| Toner 1 | +18.5 | +18.0 | good | none |
| Toner 2 | +17.0 | +17.5 | good | none |
| Toner 3 | +18.0 | +19.0 | good | none |
| Comp. Toner 1 | +10.0 | +15.0 | scumming | serious |
| Comp. Toner 2 | +11.5 | +16.5 | scumming | serious |
| Comp. Toner 3 | +9.5 | +16.0 | scumming | serious |
| Comp. Toner 4 | +19.5 | +20.0 | good | none |

TABLE 2

| | Lowest fixation temp. (°C.) | Low temp. offset disappearance temp. (°C.) | High temp. offset generation temp. (°C.) | Blocking resistance |
|---|---|---|---|---|
| Toner 1 | 155 | 120 | 220< | good |
| Toner 2 | 150 | 120 | 220< | good |
| Toner 3 | 155 | 120 | 220< | good |
| Comp. Toner 1 | 155 | 120 | 220< | good |
| Comp. Toner 2 | 150 | 120 | 220< | good |
| Comp. Toner 3 | 155 | 120 | 220< | good |
| Comp. Toner 4 | 210 | 140 | 220< | good |

It will be apparent from Table 1 that the amount of electrifications of the Toners 1 to 3 according to the present invention and Comparative Toner 4 were appropriate, that the change thereof was only slight and that the image retained the high quality even after continuously producing 50,000 copies. However, the amount of electrifications of the Comparative Toners 1 to 3 were small and when the copies were continuously produced with each of these toners, scumming was caused and the toner was scattered in the machine.

It will be apparent from Table 2 that the Toners 1 to 3 and Comparative Toners 1 to 3 each having a shell comprising a resin having thermally dissociable linkages were low in the lowest fixation temperature, and exhibited a broad non-offset zone and good blocking resistance. On the contrary, Comparative Toner 4 was high in the lowest fixation temperature, though it had no problem on the non-offset zone and blocking resistance.

EXAMPLE 4

7.0 parts by weight of carbon black "#44" (mfd. by Mitsubishi Kasei Corp.), 2.0 part by weight of charge control agent of negative charging type "Bontron S-34" (mfd. by Orient Chemical Industry Co., Ltd.), 3.5 parts by weight of 2,2'-azobisisobutyronitrile and 9.5 parts by weight of 4,4'-diphenylmethane diisocyanate "Millionate MT" (mfd. by Nippon Polyurethane Industry Co., Ltd.) were added to a mixture of 69.0 parts by weight of styrene with 31.0 parts by weight of 2-ethylhexyl acrylate and 0.9 part by weight of divinylbenzene. They were thrown into an attritor mfd. by Mitsui Miike Engineering Corp. and subjected to dispersion at 10° C. for 5 h to prepare a polymerizable composition. The polymerizable composition was added to 800 g of a 4 wt. % solution of calcium phosphate in an aqueous colloid previously prepared in a 2-l separable glass flask in such an amount that the concentration of the polymerizable composition became 30% by weight based on the total of the aqueous colloid solution and the polymerizable composition. They were dispersed and emulsified on a TK Homomixer mfd. by Tokushu Kika Kogyo Co., Ltd. at 10,000 rpm at 5° C. for 2 min. A four neck glass lid was placed on the flask and fitted with a reflux condenser, a thermometer, a dropping funnel having a nitrogen-inlet tube and a stainless steel stirring rod. The flask was placed in an electric mantle. A mixed solution of 22.0 g of resorcinol, 3.6 g of diethyl malonate, 0.5 g of 1,4-diazabicyclo[2.2.2]-octane and 40 g of deionized water was prepared and added dropwise into the flask through the dropping funnel while stirring over a period of 30 min. Then the temperature was elevated to 85° C. while continuing the stirring under nitrogen and the reaction was conducted for 10 h. After cooling the reaction mixture, the dispersant was dissolved by adding 10% aqueous hydrochloric acid solution, and the mixture was filtered. The residue was washed with water, dried at 45° C. for 12 hr under a reduced pressure of 20 mmHg, and classified by means of an air classifier to give an encapsulated toner having an average particle diameter of 9 μm wherein the shell comprises a resin having thermally dissociable urethane linkages. The glass transition point of the resin in the core material of the encapsulated toner and the softening point of the encapsulated toner were 28.7° C. and 131.0° C., respectively.

0.4 part by weight of a fine powder of a hydrophobic silica "Aerosil R-972" (mfd. by Aerosil Co. Ltd.) was added and mixed with 100 parts by weight of the encapsulated toner produced as described above to prepare the encapsulated toner composition of the present invention. This toner composition was designated as "Toner 4".

EXAMPLE 5

100 parts by weight of a copolymer consisting essentially of 75 parts by weight of styrene and 25 parts by weight of n-butyl acrylate and having a softening point of 75.3° C. and a glass transition point of 40.5° C. was premixed with 6 parts by weight of a copper phthalocyanine pigment "Sumikaprint Cyanine Blue GN-0" (mfd. by Sumitomo Chemical Co., Ltd.), 2.0 parts by weight of charge control agent of negative charging type "Copy Charge NX VP434" (mfd. by Hoechst) and 5 parts by weight of polypropylene wax "Biscol 550p" (mfd. by Sanyo Chemical Industries, Ltd.) and the mixture was melt-kneaded on a twin-screw extruder, cooled and pulverized. 40 parts by weight of the kneaded product was then mixed with 50 parts by weight of styrene, 15 parts by weight of n-butyl acrylate, 2.5 parts by weight of 2,2'-azobis(2,4-dimethylvaleronitrile), 9.0 parts by weight of an adduct of 3 mol of 2,4-tolylene diisocyanate and 1 mol of trimethylolpropane "Takenate D-102" (mfd. by Takeda Chemical Industries, Ltd.) and 0.5 part by weight of xylylene 1,4-diisothiocyanate to prepare a polymerizable composition. The polymerizable composition was added to 800 g of a 4 wt. % solution of calcium phosphate in an aqueous colloid previously prepared in a 2-l separable glass flask in such an amount that the concentration of the polymerizable composition became 30% by weight based on the total of the aqueous colloid solution and the polymerizable composition. The mixture was dispersed and emulsified on a TK Homomixer at 10,000 rpm at 5° C. for 2 min. A four neck glass lid was placed on the flask and fitted with a reflux condenser, a thermometer, a dropping funnel having a nitrogen-inlet tube and a stainless steel stirring rod. The flask was placed in an electric mantle. A mixed solution of 27.4 g of 4-acetylcatechol, 4.0 g of dimethyl malonate, 0.8 g of 1,2-ethanedithiol, 0.5 g of 1,4-diazabicyclo[2.2.2]-octane and 40 g of deionized water was prepared and added dropwise into the flask through the dropping funnel while stirring over a period of 30 min. Then the temperature was elevated to 85° C. while continuing the stirring under nitrogen and the reaction was conducted for 10 h. After cooling the reaction mixture, the dispersant was dissolved by adding 10% aqueous hydrochloric acid solution, and the mixture was filtered. The residue was washed with water, dried at 45° C. for 12 hr under a reduced pressure of 20 mmHg, and classified by means of an air classifier to give an encapsulated toner having an average particle diameter of 9 μm wherein the shell comprises a resin having thermally dissociable linkages. The glass transition point of the resin in the core material of the encapsulated toner and the softening point of the encapsulated toner were 34.0° C. and 132.5° C., respectively.

0.4 part by weight of a fine powder of a hydrophobic silica "Aerosil R-972" (mfd. by Aerosil Co. Ltd.) was added and mixed with 100 parts by weight of the encapsulated toner produced as described above to prepare the encapsulated toner composition of the present invention. This toner composition was designated as "Toner 5".

EXAMPLE 6

40 parts by weight of carbon black grafted with styrene "GP-E-3" (manufactured by Ryoyu Kogyo K. K.), which contains 40% by weight of styrene monomer, 30% by weight of polystyrene and 30% by weight of grafted carbon black, 1.5 parts by weight of charge control agent of negative charging type 3-methyl-5-nitroimidazole, 4.5 parts by weight of lauroyl peroxide, 9.0 parts by weight of tolylene diisocyanate "Coronate T-100" (mfd. by Nippon Polyurethane Industry Co., Ltd.) and 0.5 part by weight of phenyl isocyanate were added to a mixture of 50 parts by weight of styrene with 35 parts by weight of 2-ethylhexyl acrylate and 0.9 part by weight of divinylbenzene to prepare a polymerizable composition. The polymerizable composition was added to 800 g of a 4 wt. % solution of calcium phosphate in an aqueous colloid previously prepared in a 2-l separable glass flask in such an amount that the concentration of the polymerizable composition became 30% by weight based on the total of the aqueous colloid solution and the polymerizable composition. The mixture was dispersed and emulsified on a TK Homomixer mfd. by Tokushu Kika Kogyo Co., Ltd. at 10,000 rpm at 5° C. for 2 min. A four neck glass lid was placed on the flask and fitted with a reflux condenser, a thermometer, a dropping funnel having a nitrogen-inlet tube and a stainless steel stirring rod. The flask was placed in an electric mantle. A mixed solution of 24.0 g of resorcinol, 3.0 g of m-aminophenol, 2.2 g of t-butyl alcohol, 0.5 g of 1,4-diazabicyclo[2.2.2]-octane and 40 g of deionized water was prepared and added dropwise into the flask through the dropping funnel while stirring over a period of 30 min. Then the temperature was elevated to 85° C. while continuing the stirring under nitrogen and the reaction was conducted for 10 h. After cooling the reaction mixture, the dispersant was dissolved by adding 10% aqueous hydrochloric acid solution, and the mixture was filtered. The residue was washed with water, dried at 45° C. for 12 hr under a reduced pressure of 20 mmHg, and classified by means of an air classifier to give an encapsulated toner having an average particle diameter of 9 μm wherein the shell comprises a resin having thermally dissociable urethane bonds. The glass transition point of the resin in the core material of the encapsulated toner and the softening point of the encapsulated toner were 32.0° C. and 129.5° C., respectively.

0.4 part by weight of a fine powder of a hydrophobic silica "Aerosil R-972" (mfd. by Aerosil Co. Ltd.) was added and mixed with 100 parts by weight of the encapsulated toner produced as described above to prepare the encapsulated toner composition of the present invention. This toner composition was designated as "Toner 6".

COMPARATIVE EXAMPLE 5

The procedure of Example 4 was repeated except that 21.6 g of neopentyl glycol was used instead of 22.0 g of resorcinol and 3.6 g of diethyl malonate, thereby preparing a toner composition containing an encapsulated toner. This toner composition was designated as "Comparative Toner 5". The glass transition point of the resin in the core material of the encapsulated toner and the softening point of the encapsulated toner were 28.5° C. and 135.0° C., respectively.

10 parts by weight of each of the toner compositions produced in the Examples and Comparative Examples given above (Toner 4, 5 and 6, Comparative Toner 1, 2, 3 and 5) and 90 parts by weight of spheroidal ferrite powder coated with styrene/methyl methacrylate resin and having a particle size of 250 to 400 mesh as a carrier were placed in a vessel made of a polymer, and each toner composition and the ferrite powder were subjected to rotational mixing together with the vessel at a number of revolutions of 150 rpm for 20 min, thereby preparing developing agents.

The resultant developing agents were evaluated as previously described.

The results are given in Tables 3 and 4.

TABLE 3

| | Amt. of electrification (μc/g) | | Continuous printing durability test | |
|---|---|---|---|---|
| | initial | after producing 50,000 copies | quality | scattering in machine |
| Toner 4 | −18.5 | +18.0 | good | none |
| Toner 5 | −18.0 | −17.0 | good | none |
| Toner 6 | −17.0 | −16.0 | good | none |
| Comp. Toner 1 | −3.5 | +1.0 | scumming | serious |
| Comp. Toner 2 | −2.5 | +2.5 | scumming | serious |
| Comp. Toner 3 | −3.0 | +1.5 | scumming | serious |
| Comp. Toner 5 | −18.0 | −17.5 | good | none |

TABLE 4

| | Lowest fixation temp. (°C.) | Low temp. offset disappearance temp. (°C.) | High temp. offset generation temp. (°C.) | Blocking resistance |
|---|---|---|---|---|
| Toner 4 | 155 | 120 | 220< | good |
| Toner 5 | 150 | 120 | 220< | good |
| Toner 6 | 155 | 120 | 220< | good |
| Comp. Toner 1 | 155 | 120 | 220< | good |
| Comp. Toner 2 | 150 | 120 | 220< | good |
| Comp. Toner 3 | 155 | 120 | 220< | good |
| Comp. Toner 5 | 210 | 140 | 220< | good |

It will be apparent from Table 3 that the amount of electrifications of the Toners 4 to 6 according to the present invention and Comparative Toner 5 were appropriate, that the change thereof was only slight and that the image retained the high quality even after continuously producing 50,000 copies. However, the amount of electrifications of the Comparative Toners 1 to 3 was small and the polarity was reversed after producing 50,000 copies. Further, when the copies were continuously produced with each of these toners (Comparative Toners 1 to 3), scumming was caused and the toner was scattered in the machine.

It will be apparent from Table 4 that the Toners 4 to 6 and Comparative Toners 1 to 3 each having a shell comprising a resin having thermally dissociable linkages were low in the lowest fixation temperature, and exhibited a broad non-offset zone and good blocking resistance. On the contrary, Comparative Toner 5 was high in the lowest fixation temperature, though it had no problem on the non-offset zone and blocking resistance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. An encapsulated toner for heat-and-pressure fixing which comprises a heat-fusible core containing a coloring material, a thermoplastic resin binder having a glass transition point between 10° and 50° C. and 0.1% to 8.0% by weight of an electric charge control agent selected from the group consisting of a positive electric charge control agent, a negative electric charge control agent and a mixture thereof at a weight ratio of one to the other ranging from 1:0 to 1:0.5, and a shell formed so as to cover the surface of said core, wherein a main component of said shell is a resin prepared by reacting (A) an iso(thio) cyanate compound comprising (1) 0 to 30 mole % monovalent isocyanate and/or isothiocyanate compounds, and (2) 100 to 70 mole % of at least divalent isocyanate and/or isothiocyanate compounds, with (B) an active hydrogen compound comprising (3) 0 to 30 mole % of a compound having one active hydrogen atom reactive with isocyanate and/or isothiocyanate groups, and (4) 100 to 70 mole % of a compound having at least two active hydrogen atoms reactive with isocyanate and/or isothiocyanate groups, at a molar ratio of component (A) to component (B) of between 1:1 and 1:20, and wherein at least 30% of all of the linkages in which an isocyanate and/or isothiocyanate group participates are thermally dissociable linkages said encapsulated toner having a softening point between 80° C. and 150° C.

2. The encapsulated toner for heat-and-pressure fixing according to claim 1, wherein said thermally dissociable linkage is formed by the reaction of a phenolic hydroxyl or thiol group with an isocyanate or isothiocyanate group.

3. The encapsulated toner for heat-and-pressure fixing according to claim 2, wherein said compound having a phenolic hydroxyl group is at least one compound selected from the group represented by the following formulae (I), (II) and (III):

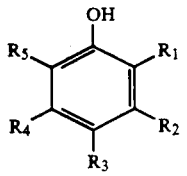

(I)

wherein $R_1$, $R_2$, $R_3$, $R_4$ and $R_5$ each independently represent a hydrogen atom, an alkyl group having 1 to 9 carbon atoms, an alkenyl group having 1 to 9 carbon atoms, an alkoxy group having 1 to 9 carbon atoms, an alkanoyl group having 1 to 9 carbon atoms, a carboalkoxy group having 2 to 9 carbon atoms, an aryl group having 6 to 9 carbon atoms or a halogen atom;

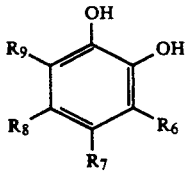

(II)

wherein $R_6$, $R_7$, $R_8$ and $R_9$ each independently represent a hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom; and

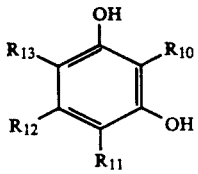

(III)

wherein $R_{10}$, $R_{11}$, $R_{12}$ and $R_{13}$ each independently represent a hydrogen atom, an alkyl group having 1 to 6 carbon atoms, an alkenyl group having 1 to 6 carbon atoms, an alkanoyl group having 1 to 6 carbon atoms, a carboalkoxy group having 2 to 6 carbon atoms, an aryl group having 6 carbon atoms or a halogen atom.

4. The encapsulated toner for heat-and-pressure fixing according to claim 1, wherein said thermoplastic resin binder comprises a vinyl resin.

5. The encapsulated toner for heat-and-pressure fixing according to claim 2, wherein the isocyanate group to be reacted with the phenolic hydroxyl group is directly bonded to an aromatic ring.

6. A toner composition for heat-and-pressure fixing, comprising an encapsulated toner as set forth in claim 1 and a fine powder of a hydrophobic silica coated thereon.

* * * * *